US006254213B1

(12) United States Patent
Ishikawa

(10) Patent No.: US 6,254,213 B1
(45) Date of Patent: Jul. 3, 2001

(54) INK DROPLET EJECTING METHOD AND APPARATUS

(75) Inventor: Hiroyuki Ishikawa, Nisshin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/201,908

(22) Filed: Nov. 30, 1998

(30) Foreign Application Priority Data

Dec. 17, 1997 (JP) ..... 9-348263

(51) Int. Cl.[7] ..... B41J 29/38; B41J 2/045
(52) U.S. Cl. ..... 347/10; 347/9; 347/69
(58) Field of Search ..... 347/10, 11, 68, 347/54, 69

(56) References Cited

U.S. PATENT DOCUMENTS

| | | | | |
|---|---|---|---|---|
| 5,017,823 | * | 5/1991 | Okumura | 310/323 |
| 5,028,936 | | 7/1991 | Bartky et al. | 346/140 |
| 5,521,619 | * | 5/1996 | Suzuki et al. | 347/10 |
| 6,092,886 | * | 7/2000 | Hosono | 347/10 |

FOREIGN PATENT DOCUMENTS

| | | |
|---|---|---|
| 61120764 | 6/1986 | (JP) . |
| 63-247051 | 10/1988 | (JP) . |
| 6084073 | 3/1994 | (JP) . |

OTHER PUBLICATIONS

Gibilisco, Stan, The Illustrated Dictionary of Electronics, 7th ed., McGraw Hill, 1997, p. 332.*

* cited by examiner

*Primary Examiner*—John Barlow
*Assistant Examiner*—Alfred E Dudding
(74) *Attorney, Agent, or Firm*—Oliff & Berridge, PLC

(57) ABSTRACT

In an ink drop let jetting method and an apparatus therefor, by setting a printing frequency used when continuous dots are printed to a predetermined value, a stable jetting becomes possible, and jetting speeds and volumes of second ink droplets and subsequent droplets may be prevented from being fluctuated. A frequency of a jet pulse signal applied to an actuator in accordance with a printing command of a plurality of consecutive dots is set to be a reciprocal of the product of a sum (integer +0.5) and the time T in which a pressure wave propagates within an ink chamber in one propagation direction. Thus, it is possible to prevent speeds and volumes of the second ink droplets and subsequent ink droplets from being fluctuated.

12 Claims, 9 Drawing Sheets

INK DROPLET EJECTING METHOD AND APPARATUS

BACKGROUND OF THE INVENTION

1. Field of the Invention

The present invention relates to an ink jet ink droplet ejecting method and apparatus.

2. Description of Related Art

In a known ink jet printer, the volume of an ink flow path is changed by deformation of a piezoelectric ceramic material, and when the flow path volume decreases, the ink present in the ink flow path is ejected as a droplet from a nozzle. However, when the flow path volume increases, the ink is introduced into the ink flow path from an ink inlet. In this type of printing head, a plurality of ink chambers is formed by partition walls made of a piezoelectric ceramic material. Ink supply means, such as ink cartridges, are connected to first ends of the ink chambers, while at the opposite, second ends, ink ejecting nozzles (hereinafter referred to as "nozzles") are provided. The partition walls are deformed in accordance with printing data to make the ink chambers smaller in volume, whereby ink droplets are ejected onto a printing medium from the nozzles to print, for example, a character or a figure.

For example, as this type of ink jet printer, a drop-on-demand type ink jet printer, which ejects ink droplets, is popular because of a high ejection efficiency and a low running cost. As an example of the drop-on-demand type there is known a shear-mode type that uses a piezoelectric material, as is disclosed in Japanese Published Unexamined Patent Application No. Sho 63-247051.

FIGS. 8A and 8B illustrate this shear-mode type of ink droplet ejecting apparatus 600 comprising a bottom wall 601, a top wall 602 and shear mode actuator walls 603 located therebetween. Each actuator wall 603 comprises a lower wall 607 bonded to the bottom wall 601 and polarized in the direction of arrow 611 and an upper wall 605 formed of a piezoelectric material, the upper wall 605 being bonded to the top wall 602 and polarized in the direction of arrow 609. Adjacent actuator walls 603, in a pair, define an ink chamber 613 therebetween, and next adjacent actuator walls 603, in a pair, define a space 615 that is narrower than the ink chamber 613.

A nozzle plate 617 having nozzles 618 is fixed to first ends of the ink chambers 613. An ink supply source (not shown) is connected to the opposite ends of the ink chambers. As illustrated in FIG. 8B, on both side faces of each actuator wall 603 are formed electrodes 619 and 621 respectively as metallized layers. More specifically, the electrode 619 is formed on the actuator wall 603 on the side of the ink chamber 613, while the electrode 621 is formed on the actuator wall 603 on the side of the space 615. The surface of the electrode 619 is covered with an insulating layer 630 for insulation from ink. The electrode 621 that faces the space 615 is connected to a ground 623, and the electrode 619 provided in each ink chamber 613 is connected to a controller 625 that provides an actuator drive signal to the electrode.

The controller 625 applies a voltage to the electrode 619 in each ink chamber, whereby the associated actuator walls 603 undergo a piezoelectric thickness slip deformation in different directions to increase the volume of the ink chamber 613. For example, as shown in FIG. 9, when a voltage E(v) is applied to an electrode 619*c* in an ink chamber 613*c*, electric fields are generated in directions of arrows 631 and 632 respectively in actuator walls 603*e* and 603*f*, so that the actuator walls 603*e* and 603*f* undergo a piezoelectric thickness slip deformation in different directions to increase the volume of the ink chamber 613*c*. At this time, the internal pressure of the ink chamber 613*c*, including a nozzle 618*c* and the vicinity thereof, decreases. The applied state of the voltage E(v) is maintained for only a one-way propagation time T of a pressure wave in the ink chamber 613. During this period, ink is supplied from the ink supply source.

The one-way propagation time T is a time required for the pressure wave in the ink chamber 613 to propagate longitudinally through the same chamber. Given that the length of the ink chamber 613 is L and the velocity of sound in the ink present in the ink chamber 613 is a, the time T is determined to be T=L/a.

According to pressure wave propagation theory, upon lapse of time T or an odd-multiple time thereof after the above-application of voltage, the internal pressure of the ink chamber 613 reverses into a positive pressure. In conformity with this timing, the voltage being applied to the electrode 619*c* in the ink chamber 613*c* is returned to 0(v). As a result, the actuator walls 603*e* and 603*f* revert to their original state (FIG. 8A) before the deformation, whereby a pressure is applied to the ink. At this time, the above positive pressure and the pressure developed by reverting of the actuator walls 603*e* and 603*f* to their original state before the deformation are added together to afford a relatively high pressure in the vicinity of the nozzle 618*c* in the ink chamber 613*c*, whereby an ink droplet is ejected from the nozzle 618*c*. An ink supply passage 626 communicating with the ink chamber 613 is formed by members 627 and 628.

Conventionally, in this kind of apparatus 600 for jetting droplets of ink, when a printing frequency requires an increase of when droplets of ink of consecutive dots are jetted then, within a certain frequency range, the ink-jet tends to become unstable due to a meniscus vibration of ink within the nozzle. As a consequence, during continuous ink-jetting, jet speeds of second and third ink droplets and volumes of ink droplets are fluctuated and become uneven, thereby resulting in decreased printing quality.

Conventionally, as shown in Japanese Published Unexamined Patent Application No. Hei 6-84073, to compensate for the influence of the meniscus vibration of ink-jetting and to effectively use energy required when a pulse voltage rises, there is a method known in which a time period ranging from the trailing edge of a pulse voltage to the leading edge of the next pulse voltage is set to ½ of a natural vibration period of a nozzle portion. However, according to this method, vibration of the next ink-jetting is overlapped with vibration generated when a piezoelectric element returns to a stable position after a vibration of ink-jetting is stopped. This method does not provide a counter-measure executed during the continuous vibration at a high printing frequency.

Additionally, as shown in Japanese Published Unexamined Patent Application No. Sho 61-120764, a method is known in which a drive signal for a piezoelectric element is controlled with reference to a dot interval in such a manner that the volume of droplets of ink remains constant regardless of the dot interval. However, this method is not able to prevent fluctuation of the volume of ink droplets of a second and subsequent continuous dots.

SUMMARY OF THE INVENTION

The present invention solves the above-mentioned problems, and provides an ink ejecting method and apparatus in which a printing frequency, used when continuous dots are printed, is set to a predetermined value so that stable ink-jetting is possible during continuous vibration, fluctuation of jetting speeds and volumes of ink droplets of a second dot, and subsequent dots are prevented and excellent ink-jet printing quality is provided.

In order to attain the above-described objects, according to a first aspect of the present invention, there is provided an ink ejecting method in which a pressure wave is generated within an ink chamber by applying a jet pulse signal to an actuator which changes a capacity of the ink chamber containing a quantity of ink to apply a pressure to the ink thereby jetting droplets of ink from a nozzle. This ink ejecting method uses a printing frequency such that volumes of ink droplets of a second dot and subsequent dots become substantially equal to a volume of the ink droplet of the first dot when the jet pulse signal is applied to the actuator in accordance with a printing command for a plurality of consecutive dots. According to this method, fluctuation of the volume of droplets of ink required when droplets of a plurality of dots are continuously ink-jetted is prevented, thereby making it possible to realize high frequency printing.

Also, according to a second aspect of the present invention in an ink ejecting method, the jet pulse signal applied to the actuator in accordance with the printing command for the plurality of consecutive dots has a frequency that is equal to a reciprocal of a value approximately equal to a quantity time T, in which a pressure wave propagates in one direction within the ink chamber, multiplied by a multiplier that is an integer plus 0.5. According to this method, setting the jet pulse signal frequency equal to a reciprocal of the product of the quantity time T and an odd integer decreases the speeds and volumes of droplets of ink of a second dot and subsequent dots. Alternatively, setting the frequency equal to a reciprocal of the product of the quantity time T and an even integer increases the speeds and volumes of droplets of ink of a second dot and subsequent dots. However, setting the jet pulse signal frequency equal to a reciprocal of the product of the quantity time T and an integer plus 0.5 maintains the speeds and volumes of droplets of ink of a second dot and subsequent dots at substantially constant values.

Also, according to a third aspect of the present invention, there is provided an ink ejecting apparatus which is comprised of an ink chamber that contains a quantity of ink, an actuator that changes a capacity of the ink chamber, a driving power source that applies an electrical signal to the actuator, and a controller. The controller controls a volume capacity of the ink chamber with selective application of a jet pulse signal to the actuator from the driving power source to generate a pressure wave within the ink chamber and application of a pressure to a quantity of ink contained in the ink chamber by decreasing the volume capacity from an increased state to a natural state after a time that is an integer multiple of T elapsed to jet droplets of ink. The controller controls the driving power source to apply a jet pulse signal with a frequency that is the reciprocal of the approximate product of the quantity T and an integer plus 0.5 to the actuator in accordance with a printing command of a plurality of consecutive dots. As a result of the this arrangement, the volume and print speed associated with a second dot and subsequent dots is substantially maintained.

According to the present invention, if the jet pulse signal frequency for printing a plurality of consecutive dots is set in such a manner that ink droplet volumes of the second dot and subsequent dots are equal to that of the first dot, then even when dots are printed at a high frequency, stable ink jetting is possible during continuous vibration so that the ink jetting speeds and ink droplet volumes are maintained. In particular, the jet pulse signal frequency is set equal to the reciprocal of the approximate product of the quantity time T and an integer plus 0.5, whereby the speeds and volumes of the ink droplets used when dots are continuously printed are maintained provide high quality printing.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 8A:
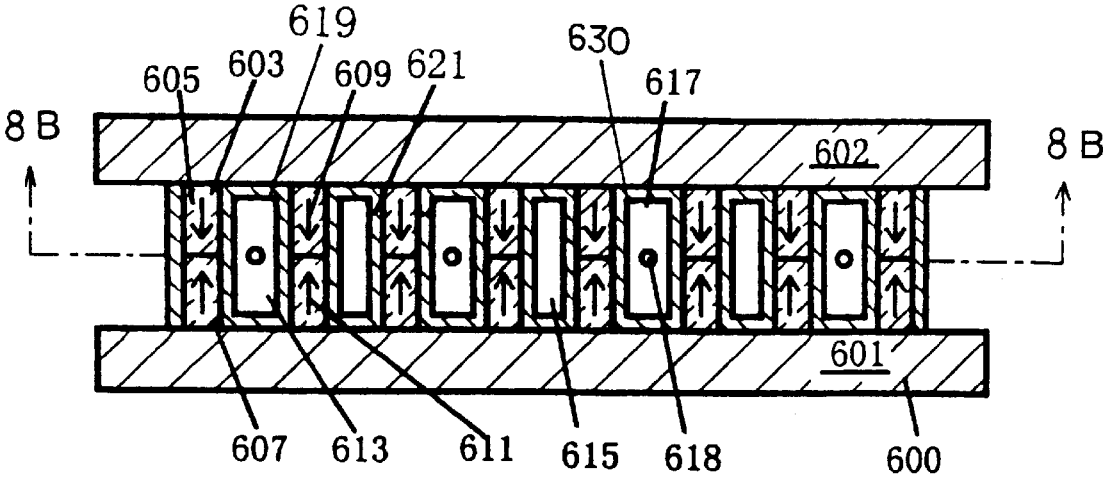
FIG. 8A is a longitudinal sectional view of an ink jet portion of a recording head.
Figure 8B:
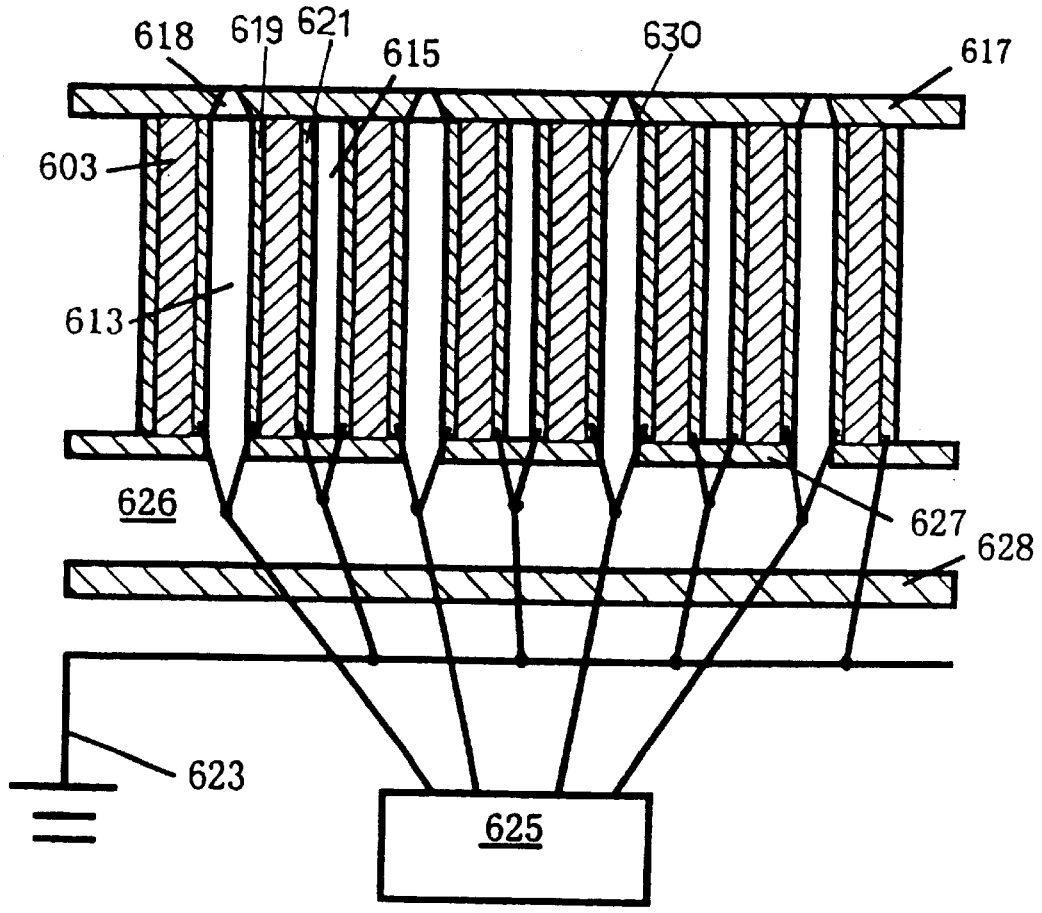
FIG. 8B is a cross-sectional view of the longitudinal section view illustrated in FIG. 8A viewed from the line of sight identified by 8B—8B.

A preferred embodiment of the present invention will hereinafter be described with reference to the drawings. An exemplary arrangement of a mechanical portion of the apparatus for jetting droplets of ink according to this embodiment is illustrated in FIGS. 8A and 8B, and therefore need not be described.

Exemplary sizes of a present ink droplet jetting apparatus 600 will now be described. A length L of an ink chamber 613 may be, for example, 15 mm. A size of a nozzle 618 is such that a diameter of an ink drop jetting side is, for example, 40 $\mu$m. A diameter of an ink chamber 613 side is 72 $\mu$m and a length is 100 $\mu$m for example. A viscosity of ink, as used in the experiments may be about 2 mPa·s at 25° C. and its surface tension may be 30 mN/m. Thus, a ratio of the length, L, to the speed of sound, a, in the ink contained in this ink chamber 613 is for example 15 $\mu$sec. The ratio of the length, L (in meters), to the speed of sound, a (in meters per second), is equal to the quantity of time, T, required for a sound wave to traverse the length of the ink chamber 613. The quantity T can be considered a period for a sound wave to propagate the length of the ink chamber 613. The quantity of time T is essentially a period of a signal with pulses traversing the length of the ink chamber 613 individually, with no more than one pulse traversing the length of the ink chamber at any time.

Figure 1:
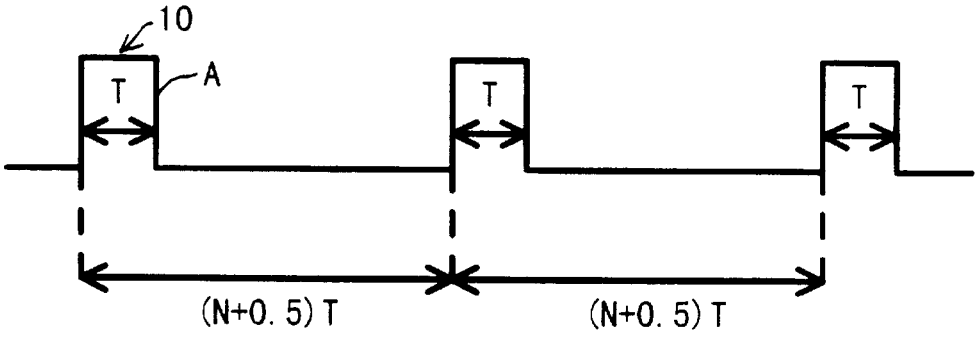
FIGS. 1 a diagram showing a driving waveform of an ink droplet jetting apparatus according to an embodiment of the present invention.

FIG. 1 shows a waveform of a driving voltage applied to an electrode 619 disposed within the ink chamber 613 according to an embodiment of the present invention. An illustrated driving waveform 10 is a jet pulse signal A that is used to jet droplets of ink when one dot is printed. A peak voltage value of the driving waveform is 20 (v), for example.

A pulse width of the jet pulse signal A is the quantity of time T, or an odd-multiple of the time T. The period of the jet pulse signal A is approximately (N+0.5)T where N is an integer. Time period T is the time necessary for a pressure wave to travel a length of the ink chamber in one-direction. The period of the jet pulse signal A required when subsequent dots are printed continuously becomes 100 $\mu$sec when the frequency of the driving waveform is set to 10 kHz because frequency is the reciprocal of period.

When jet pulse signal A is applied in accordance with a printing command of a plurality of continuous dots, a printing frequency is used such that volumes of droplets of ink of a second dot and subsequent dots become approximately equal to that of the first dot. More specifically, as is clear from ink droplet measured data shown in FIGS. 2 and 3, which will be described below, the frequency of the jet pulse signal A is set approximately equal to the reciprocal of the product of the period T multiplied by the sum of an integer and 0.5.

Figure 2A:
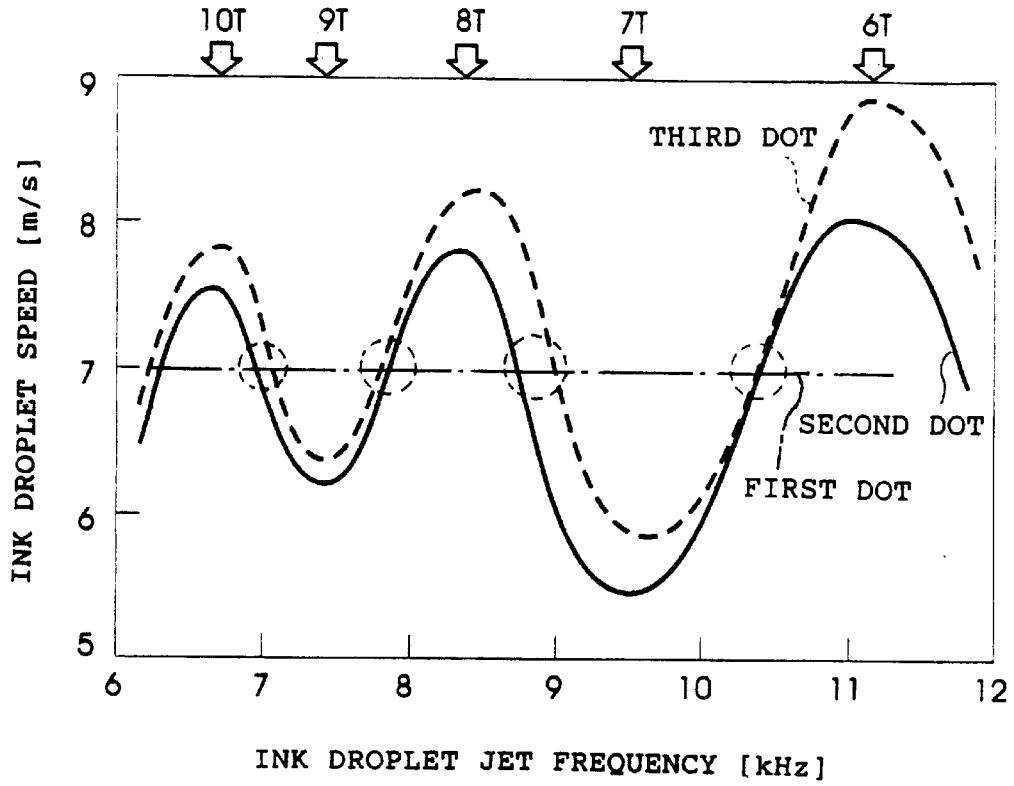
FIG. 2A is a graph showing measured data of ink droplet speeds obtained when an ink droplet jetting frequency is varied.
Figure 2B:
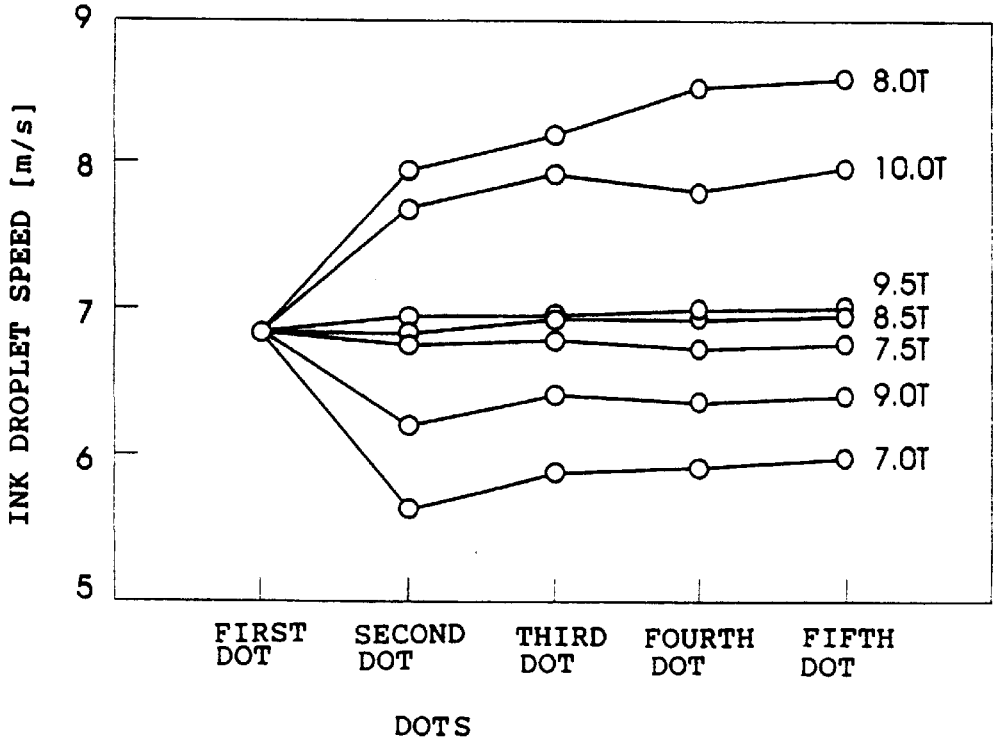
FIG. 2B is a graph showing measured data of ink droplet speeds of first to fifth dots obtained when the apparatus is driven at a variety of periods.
Figure 3A:
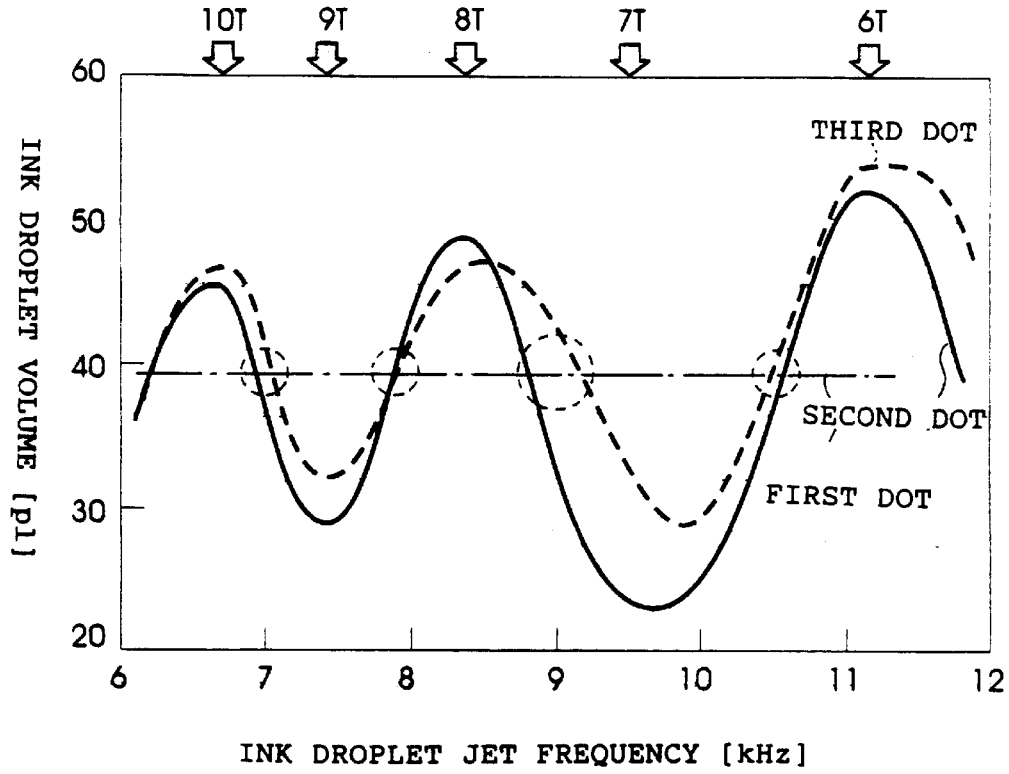
FIG. 3A is a graph showing measured data of ink droplet volumes obtained when an ink droplet jetting frequency is varied.
Figure 3B:
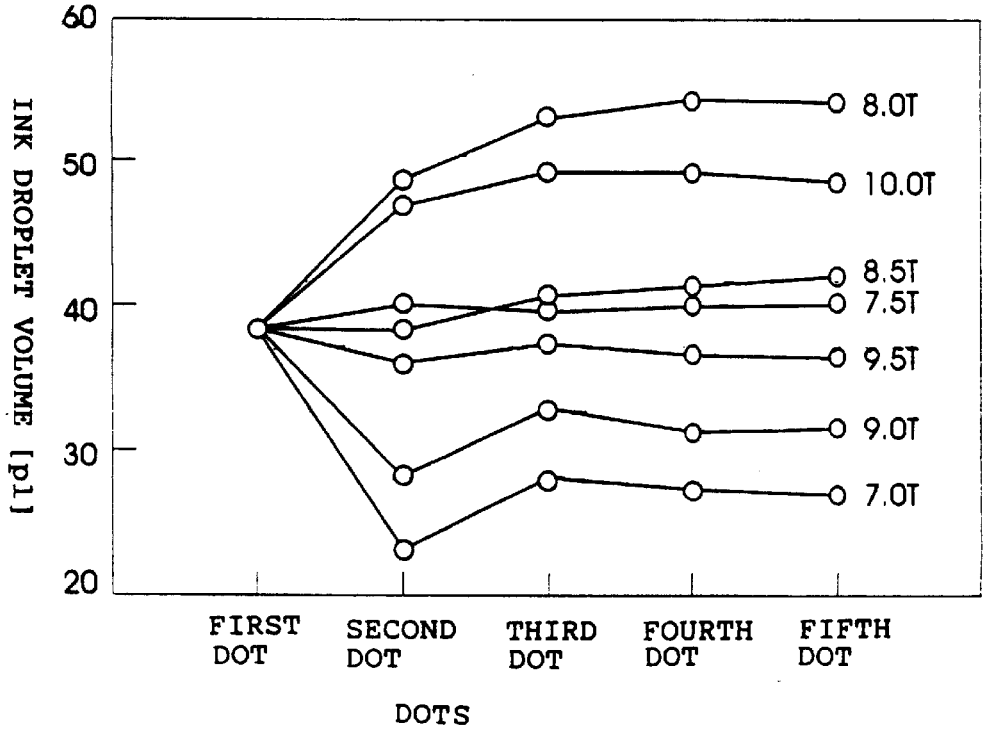
FIG. 3B is a graph showing measured data of ink droplet volumes of first to fifth dots obtained when the apparatus is driven at a variety of periods.

FIG. 2A shows ink droplet speeds measured when the ink droplet jet frequency was varied, and FIG. 2B shows ink droplet speeds of the first five dots obtained when the ink droplet jet apparatus is driven at a variety of different frequencies corresponding to periods 6.0T through 10.0T. FIG. 3A shows ink droplet volumes obtained when the ink droplet jet frequency was changed, and FIG. 3B shows ink droplet volumes of the first five dots obtained when the ink droplet jet apparatus is driven at a variety of frequencies corresponding to periods 6.0T to 10.0T. In FIG. 2A, the solid line indicates the results from plotting measured data obtained when the ink droplet speed for the second dot is measured at a variety of driving waveform frequencies. A dashed line indicates the results from plotting measured data obtained when the third dot is measured at a variety of driving waveform frequencies. A dot-and-dash line represents ink droplet speeds and volumes of the first dot regardless of driving waveform frequency. As illustrated in FIG. 2A, the ink droplet speed of the first dot is maintained at approximately 7 m/s regardless of the driving waveform frequency. Similarly, as illustrated in FIG. 3A,the volume of the ink droplets for the first dot remain constant at approximately 40 pl (picoliter).

As shown in FIGS. 2A and 3A, the ink droplet speeds and volumes for the second and third dots are increased when the period of the driving waveform is even-numbered multiples of the period T, for example, 6T, 8T, 10T. The ink droplet speeds and volumes for the second and third dots are decreased when the period of the driving waveform is odd-numbered multiples of the period T, for example, 7T, 9T. When the driving waveform period is equal to 6T, 90 $\mu$sec when T equals 15 $\mu$sec, the associated driving waveform frequency is approximately 11 kHz. In FIGS. 2A and 2B, the periods of the areas, shown by circles, in which the characteristic curves for the second and third dots cross the dot-and-dash line, which represents the value of the first dots, are located at approximately 6.5T, 7.5T, 8.5T, 9.5T. Therefore, the ink droplet volumes and speeds are approximately the same for the first, second and third dots at the frequencies within these circular areas mathematically represented as the product of the quantity time T and the sum of integers plus 0.5. Accordingly, by selecting these periods, it is possible to make the ink droplet speeds and the volumes of the second and third dots equal to those of the first dots. This will be understood from the graphs of FIGS. 2B and 3B. Therefore, by manipulating the period of the drive waveform equal droplet volume and speed is provided. This is performed by manipulating the drive waveform frequency because frequency is the reciprocal of the period.

Figure 4:
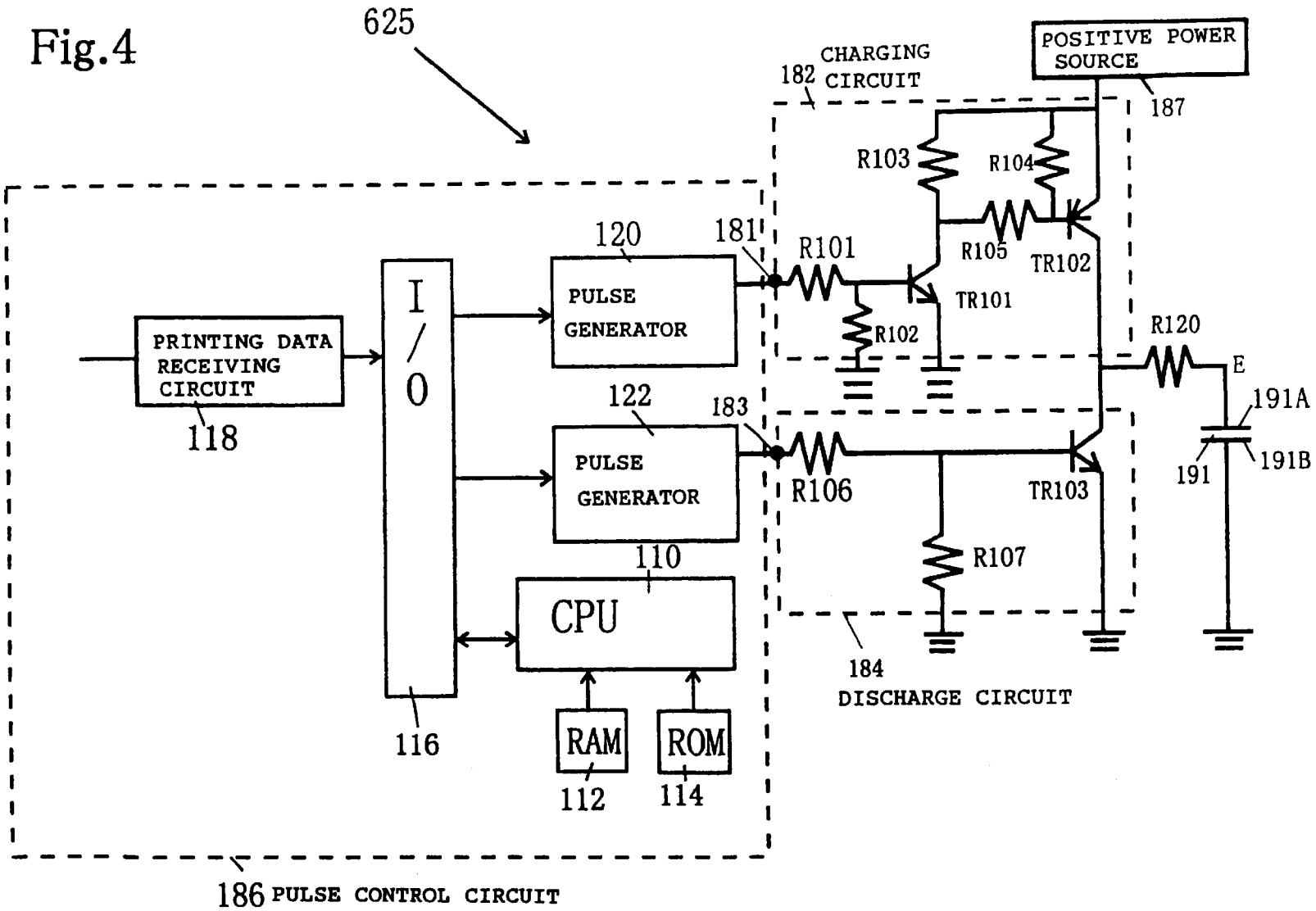
FIG. 4 is a diagram showing a driving circuit of an ink droplet jetting apparatus.
Figure 5:
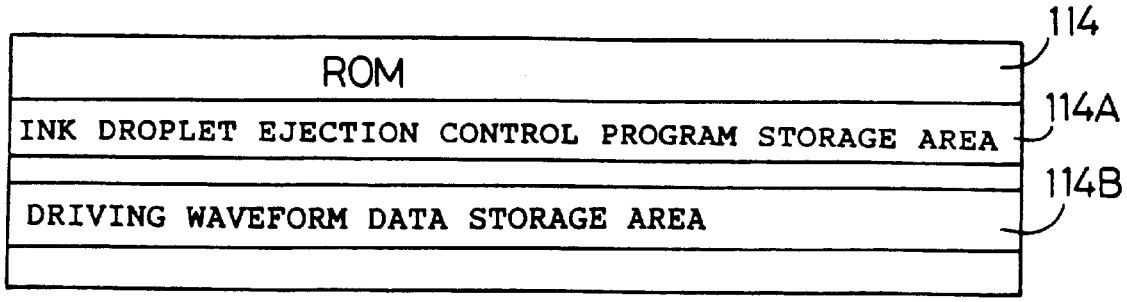
FIG. 5 is a diagram showing a storage area of a ROM of a controller of the ink droplet jetting apparatus.

A controller for realizing the aforementioned driving waveform 10 according to a preferred embodiment will be described with reference to FIGS. 4 and 5. A controller 625, shown in FIG. 4, comprises a charging circuit 182, a discharging circuit 184 and a pulse control circuit 186. A piezoelectric material of an actuator wall 603 and electrodes 619, 621 are equivalently expressed by capacitor 191. Reference numerals 191A and 191B denote terminals of the capacitor.

Input pulse signals are input into terminals 181 and 183. These input pulse signals are used to set voltages supplied to the electrode 619 within the ink chamber 613 to E (v) and 0 (v), respectively. The charging circuit 182 comprises resistors R101, R102, R103, R104, R105 and transistors TR101, TR102.

When an ON signal (+5 v) is input to the input terminal 181, the transistor TR101 is controlled through the resistor R101 so that a current flows from a positive power supply 187 through the resistor R103 to the transistor TR101 along the collector to the emitter direction. Therefore, divided voltages of the voltage applied to the resistors R104 and R105 connected to the positive power supply 187 are raised and a current that flows in the base of the transistor TR102 increases, thereby controlling the emitter-collector path of the transistor TR102. A voltage 20(v) from the positive power source 187 is applied through the collector and the emitter of the transistor TR102 and the resistor R120 to the capacitor 191 at the terminal 191A.

Figure 9:
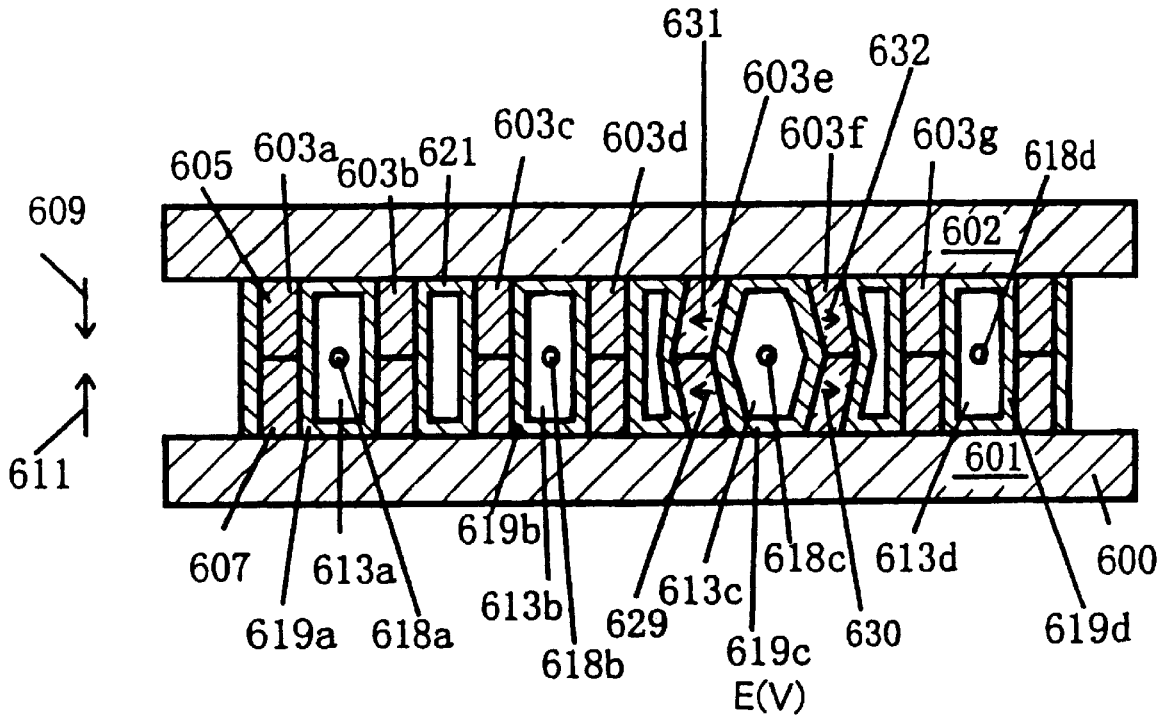
FIG. 9 is a longitudinal sectional view showing an operation of an ink jet unit of a recording head.

The discharging circuit 184 will be described next. The discharging circuit 184 comprises resistors R106, R107 and a transistor TR103. When an ON signal (+5 v) is input to the input terminal 183, the transistor TR103 is controlled through the resistor R106, thereby resulting in the terminal 191A on the side of the resistor R120 of the capacitor 191 being connected to the ground through the resistor R120. Therefore, electric charges applied to the actuator wall 603 of the ink chamber 613, shown in FIGS. 8 and 9, are discharged.

The pulse control circuit 186 generates pulse signals that are input to the input terminal 181 of the charging circuit 182 and the input terminal 183 of the discharging circuit 184. The pulse control circuit 186 is provided with a CPU 110 for performing a variety of computations. To the CPU 110, there are connected a RAM 112 for memorizing printing data and a variety of data and a ROM 114 for memorizing sequence data in which on/off signals are generated in accordance with a control program and a timing of the pulse control circuit 186. The ROM 114 includes, as shown in FIG. 5, an ink droplet jet control program area 114A and a driving waveform data storage area 114B. The sequence data of the driving waveform 10 is stored in the driving waveform data storage area 114B.

Further, the CPU 110 is connected to an I/O bus 116 for exchanging a variety of data, and a printing data receiving circuit 118 and pulse generators 120 and 122 are connected to the I/O bus 116. An output from the pulse generator 120 is connected to the input terminal 181 of the charging circuit 182, and an output from the pulse generator 122 is connected to the input terminal 183 of the discharging circuit 184.

The CPU 110 controls the pulse generators 120 and 122 in accordance with the sequence data memorized in the driving waveform data storage area 114B. Therefore, by memorizing various kinds of patterns of the above-mentioned timing in the driving waveform data storage area 114B within the ROM 114 in advance, it is possible to supply the drive pulse of the driving waveform 10 shown in FIG. 1 to the actuator wall 603.

The quantity of each of the pulse generators 120, 122, charging circuit 182 and discharging circuit 184 are equal to the number of nozzles in an apparatus. Therefore, while this embodiment typically describes the manner in which one nozzle is controlled, other nozzles are controlled similarly as described above.

Figure 6A:
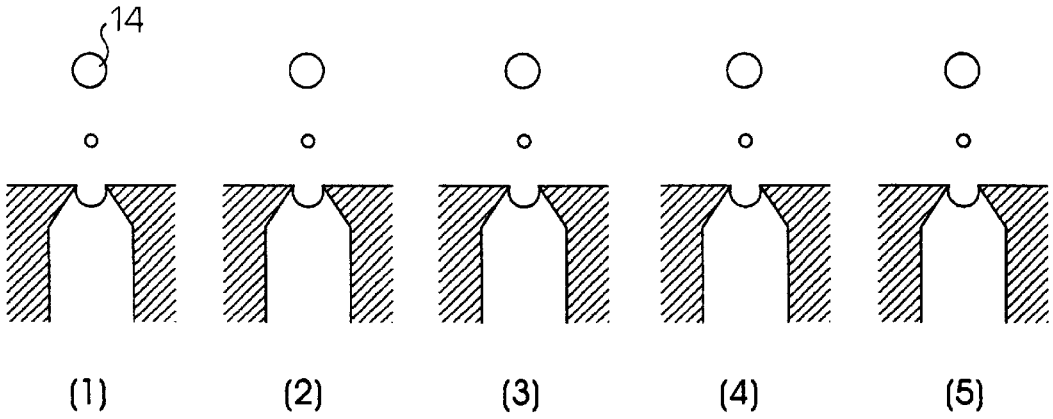
FIGS. 6A, 6B, 6C are diagrams showing the manner in which ink droplets are jetted from a nozzle when the ink droplet jetting apparatus is driven at a variety of printing frequencies.
Figure 6B:
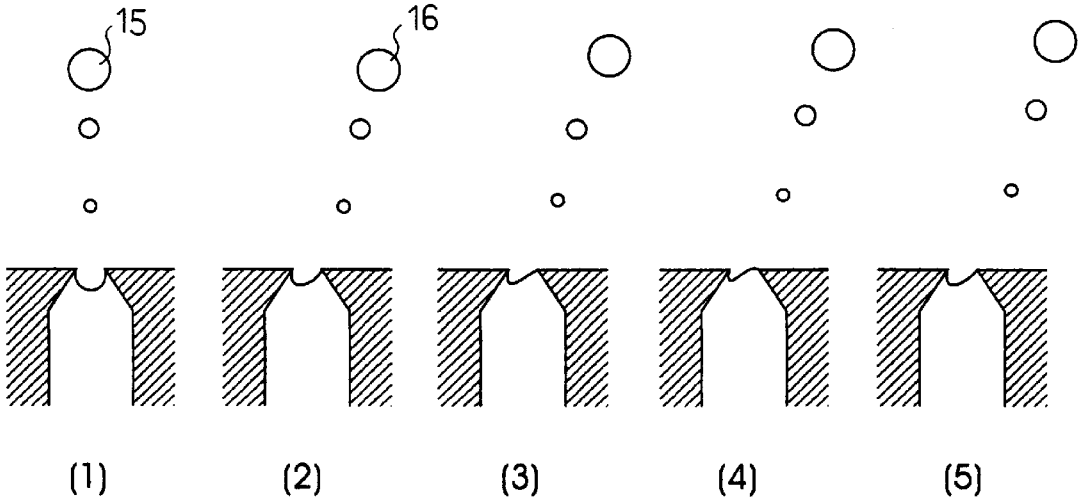
Figure 6C:
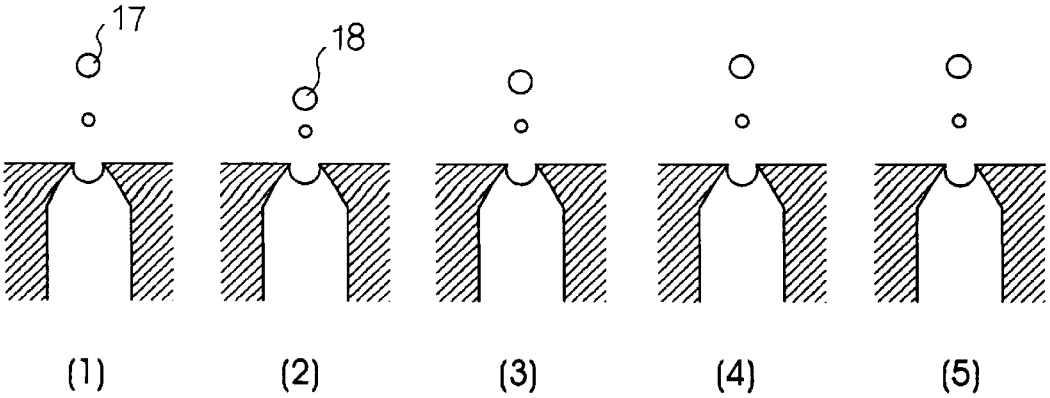

FIGS. 6A, 6B and 6C illustrate variations of droplets of ink jetted from the nozzle depending upon the printing frequency. FIG. 6A illustrates how the sizes of droplets of ink jetted from the nozzle when droplets of ink of continuous dots (here, one(1) to five(5) dots) are jetted at a period (integer +0.5) times the period T. FIG. 6B illustrates how the droplets of ink are jetted from the nozzle when the period is an even-number multiple of the time T. FIG. 6C illustrates how droplets of ink are jetted from the nozzle when the period is an odd-number multiple of the time T. In FIG. 6A, the speeds and volumes of the ink droplet 14 of the continuous dots are not changed at all based on the dot being formed. In FIG. 6B, as a result of increasing the period to an even multiple of T, the speed and the volume of the second ink droplet 16 are increased relative to the first ink droplet 15, as indicated by a change in droplet size and the larger number of drops produced for the fifth dot(5) in relation to the first dot(1). In FIG. 6C, as a result of increasing the period to an odd multiple of T, the speed and the volume of the second ink droplet 18 are decreased relative to the first ink droplet 17 of the continuous dots.

Figure 7:
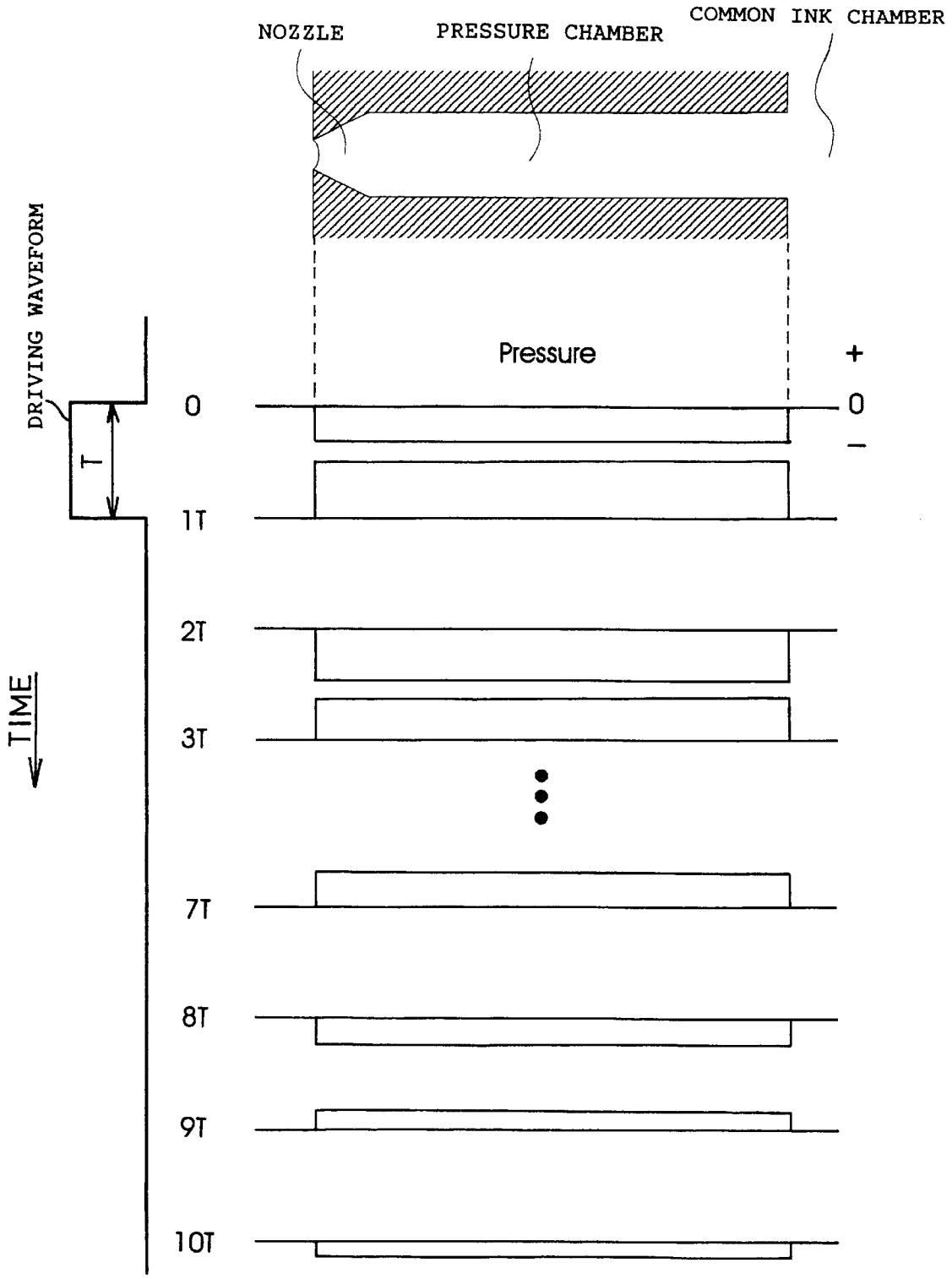
FIG. 7 is a diagram used to explain the manner in which a pressure within a pressure chamber is changed when a jetting pulse is applied thereto.

FIG. 7 is a diagram used to explain the manner in which the pressure within the ink chamber 613, referred to as a pressure chamber, changes when a jetted pulse is applied to the ink droplet jetting apparatus 600. Reference numerals 1T to 10T denote time transitions. At the leading edge time 0 of the jetted pulse, the capacity of the pressure chamber increases to generate a negative-pressure pressure wave. At a trailing edge timing point of the jetted pulse obtained after the time 1T, the capacity of the pressure chamber is decreased to the natural state resulting in a positive-pressure pressure wave. The positive pressure induced by the positive-pressure pressure wave becomes negative pressure induced by the negative-pressure pressure wave during a time period of 2T. The phase of the pressure will hereinafter be inverted at every time T and attenuated.

Since the pressure changes as a result of the jet pulse, as described above, if the ink droplet jet apparatus is continuously driven at a period that is an even multiple of the period T, then the speeds and volumes of the droplets for the second and third dots increase. If the ink droplet jet apparatus is continuously driven at a period that is an odd multiple of the period T, then the speeds and volumes of the droplets second and third dots decrease. Therefore, if the ink droplet jet apparatus is driven at an approximately intermediate period between the even and odd multiples of the period T, it is possible to suppress the speed and volume of the ink droplet from being fluctuated.

While the embodiment has been described so far, the present invention is not limited thereto. For example, while there is illustrated only the driving signal having one jet pulse signal A as the main driving signal as described above, the present invention is not limited thereto, and a main driving signal may comprise two jet pulses, for example.

Also, the ink droplet jet apparatus 600 is not limited to the arrangement of the above-mentioned embodiment, and it is possible to use such an ink droplet jet apparatus in which a polarization direction of a piezoelectric material is reversed.

While the air chambers 615 are provided on both sides of the ink chamber 613, as described above, air chambers need not be provided, and ink chambers may be located adjoining to each other. Further, while the actuator may be of a shearing mode type, the present invention is not limited thereto, and an actuator may be of such a type that piezoelectric materials are laminated and a pressure wave is generated by a deformation of its laminated direction. Also, the material is not limited to the piezoelectric material; rather, any material and structure that generate a pressure wave in an ink chamber may be used.

What is claimed is:

1. An ink droplet ejecting method in which a jet pulse signal is applied to an actuator in accordance with a printing command of a plurality of consecutive dots that changes the volume of an ink chamber filled with ink, to generate a pressure wave within the ink chamber, thereby applying pressure to the ink and allowing a droplet of the ink to be ejected from a nozzle, wherein the pressure is applied to the ink at a printing frequency such that volumes of ink droplets of a second dot and subsequent dots are substantially equal to a volume of an ink droplet of a first dot when the jet pulse signal is applied to the actuator.

2. The ink droplet ejecting method of claim 1, wherein the jet pulse signal applied to the actuator in accordance with the printing command of the plurality of consecutive dots has a frequency of a reciprocal of approximately (integer +0.5) times a time T, where T is the time in which a pressure wave propagates one-way within the ink chamber.

3. An ink droplet ejecting apparatus including:

an ink chamber containing ink;

an actuator for changing the volume of the ink chamber;

a driving power source for applying an electric signal to the actuator; and a controller that controls the driving power source so that a jet pulse signal is applied to the actuator from the driving power source to increase the volume of the ink chamber and thereby generate a pressure wave in the ink chamber, wherein, the volume of the ink chamber is decreased from an increased volume state to a normal volume state after a lapse of an odd-multiple time of the time T, thereby applying pressure to the ink present in the ink chamber and allowing an ink droplet to be ejected, where T is the approximate time required for a one-way propagation of the pressure wave through the ink chamber, and the controller applies a jet pulse signal having a frequency of approximately a reciprocal of (N+0.5) T, where T is the time in which a pressure wave propagates one-way within the ink chamber and N is an integer.

4. An ink droplet ejecting method comprising:

filling an ink chamber with ink; and applying pressure to the ink in the ink chamber to eject an ink droplet from a nozzle, the pressure being applied at a frequency equal to a reciprocal of a product of a period of time T, in which a pressure wave propagates one-way within the ink chamber and the sum of an integer and 0.5.

5. The method of claim 4, wherein volumes of ink droplets of a second dot and subsequent dots are substantially equal to a volume of an ink droplet of a first dot.

6. The method of claim 4, wherein applying pressure to the ink in the ink chamber to eject an ink droplet from the nozzle comprises applying a jet pulse signal to an actuator to change a volume of the ink chamber to generate a pressure wave in the ink chamber.

7. The method of claim 6, wherein the jet pulse signal is applied to said actuator in accordance with a printing command of a plurality of consecutive dots.

8. The method of claim 7, wherein the jet pulse signal applied to the actuator is produced by a driving power source controlled in accordance with the printing command of the plurality of consecutive dots.

9. An ink droplet ejecting apparatus including:

an ink chamber that contains ink;

a nozzle coupled to the ink chamber that ejects the ink contained in the ink chamber;

an actuator, operationally coupled to the ink chamber, that applies pressure to the ink in the ink chamber to eject an ink droplet from the nozzle; and a controller that controls the actuator to apply pressure to the ink at a frequency equal to a reciprocal of a product of a period of time T and a sum of an integer and 0.5, where T is the period of time necessary for a pressure wave to propagate one-way within the ink chamber.

10. The apparatus of claim 9, wherein the actuator applies pressure to the ink in the ink chamber by changing the volume of the ink chamber.

11. The apparatus of claim 9, further comprising a driving power source coupled to the actuator and the controller for applying an electric signal to the actuator, wherein the controller controls the actuator by applying a jet pulse signal to the actuator from the driving power source to change the volume of the ink chamber.

12. The apparatus of claim 11, wherein the jet pulse signal is applied to the actuator from the driving power source to increase the volume of the ink chamber to an increased state and thereby generate a pressure wave in the ink chamber and the volume of the ink chamber is decreased from the increased state to a normal state after a lapse of a time period that is an odd-multiple of the time period T, thereby applying pressure to the ink present in the ink chamber and allowing an ink droplet to be ejected.

* * * * *